United States Patent [19]

Kristofek

[11] 4,450,512

[45] May 22, 1984

[54] ARRANGEMENT FOR MOUNTING A THERMAL PROTECTIVE DEVICE IN A RECESS MOUNTED LIGHTING FIXTURE

[75] Inventor: Paul J. Kristofek, Hickory Hills, Ill.

[73] Assignee: McGraw-Edison Company, Rolling Meadows, Ill.

[21] Appl. No.: 416,880

[22] Filed: Sep. 13, 1982

[51] Int. Cl.[3] ..... F21V 29/00

[52] U.S. Cl. ..... 362/276; 362/147; 362/294; 362/295; 362/364; 362/373; 362/376; 362/802

[58] Field of Search ..... 362/147, 276, 294, 295, 362/364, 373, 376, 802

[56] References Cited

U.S. PATENT DOCUMENTS 4,250,540 2/1981 Kristofek ..... 362/404
4,293,895 10/1981 Kristofek ..... 362/364
4,358,635 11/1982 Druffel .

*Primary Examiner*—Stephen J. Lechert, Jr.
*Attorney, Agent, or Firm*—Charles W. MacKinnon; Jon C. Gealow; Ronald J. LaPorte

[57] ABSTRACT

An arrangement for mounting a thermal protective device including a case in which there is mounted a temperature sensitive element, in a lighting fixture adapted for recessed mounting in a ceiling support surface, includes a receptacle dimensioned for receipt of the thermal protective device. The receptacle is mounted on the interior surface of the side wall of the recess mounted housing of the lighting fixture. The housing side wall defines an aperture predeterminedly located therein with which the temperature sensitive element is aligned for sensing the temperature of the area adjacent the exterior surface of the housing side wall. The receptacle includes fingers for biasing the thermal protective device into engagement with the interior surface of the housing side wall. The receptacle is constructed of reflective material to reflect heat emanating from the lamp of the lighting fixture away from the thermal protective device. In a preferred embodiment, the case of the thermal protective device includes a frame-shaped projection aligned with the temperature sensitive element therein. The projection is receivable in the aperture defined in the housing side wall for securing the thermal protective device in place thereon and for aligning the temperature sensitive element with the aperture.

15 Claims, 8 Drawing Figures

ARRANGEMENT FOR MOUNTING A THERMAL PROTECTIVE DEVICE IN A RECESS MOUNTED LIGHTING FIXTURE

BACKGROUND OF THE INVENTION

This invention relates generally to thermal protective devices for recessed lighting fixtures and, more particularly, to an arrangement for mounting such thermal protective devices on recessed lighting fixtures.

It has been recognized in the lighting industry that lighting fixtures mountable on ceiling or wall surfaces, especially those designed to be recessed in such surfaces, may become a fire hazard under certain circumstances. Fires have been known to occur when too large wattage lamps are used in the lighting fixtures and/or where insulation surrounding the fixture prevents heat produced by the fixture from properly dissipating.

To aid in the prevention of fires caused in the aforementioned manner, thermal protective devices, which interrupt current to the lighting fixture when overheating in the area surrounding the fixture occurs, are being employed. The need for such thermal protective devices in lighting fixtures, especially recessed fixtures, has been recognized by safety organizations, such as, for example, Underwriters Laboratory and the National Fire Prevention Association. Underwriter's Laboratory has issued specific standards for the operation of thermal protective devices used in recess mounted lighting fixtures.

One such type of thermal protective device designed for use in lighting fixtures is illustrated in U.S. Pat. No. 4,314,223, issued Feb. 2, 1982, in my name and assigned to the same assignee as the instant application. Thermal protective devices of the type described in the last-mentioned patent and similar devices are being employed in conjunction with recess mounted and other lighting fixtures with success in the prevention of overheating thereof.

One drawback associated with the use of a thermal protective device in conjunction with a recess mounted lighting fixture, is the placement of and manner in which to mount the device on the fixture. A desirable location for mounting a thermal protective device is in the interior of the lighting fixture housing or "can" received in the ceiling or other support surface. However, in such location, an increase in temperature of the environment surrounding the housing may be difficult to sense. The thermal protective device is, however, protected from damage which could occur if the device were mounted outside the housing. Rather than permitting the thermal protective device merely to be suspended in the housing where it could interfere with the lamp and other instrumentalities of the fixture as well as become damaged itself, it has been determined that it would be advantageous to mount the device directly on the inner surface of the side wall of the housing at a predetermined location therealong. A mounting arrangement to accomplish the latter would, however, need to be one which would permit proper sensing of the temperature surrounding the fixture, be simple to use, yet efficient and relatively inexpensive to produce.

SUMMARY OF THE INVENTION

Accordingly, it is a primary object of the present invention to provide a new and improved arrangement for mounting a thermal protective device on the inside surface of the housing wall of a recess mounted lighting fixture.

It is another object of the present invention to provide a mounting arrangement of the aforementioned type which is relatively simple in construction, effective in securing the thermal protective device in place on the housing side wall of the recessed lighting fixture and which is relatively inexpensive to fabricate.

Briefly, a preferred embodiment of the mounting arrangement for a thermal protective device according to the invention includes a clip-on receptacle having a pair of fingers and a tab dimensioned for receipt in specially dimensioned apertures defined in the side wall of the housing of a recessed lighting fixture. When in a mounted position on the inner surface of the side wall of the housing, the receptacle defines a predeterminedly dimensioned enclosure having an open end for receipt of a thermal protective device dimensioned similarly to the enclosure.

Spring fingers defined on a wall of the receptacle engage an adjacent side wall of the thermal protective device, forcing the opposite side wall of the device into contacting engagement with the inner surface of the wall fixture housing. A projection formed on the side wall of the thermal protective device engaging the housing wall, is received in a similarly dimensioned aperture aligned with and defined in the housing wall, thereby to prevent easy removal of the thermal protective device from the fixture housing. Upon mounting the thermal protective device on the housing wall, the temperature sensitive element within the case of the device is aligned with the aforementioned aperture in the housing wall permitting the temperature sensitive element to accurately sense the temperature along the outer wall of the housing.

The clip-on receptacle designed to retain the thermal protective device is preferably constructed or coated with a reflective material to block heat emanating from the lamp of the fixture, from the thermal protective device.

DETAILED DESCRIPTION OF THE DRAWINGS

Figure 1:
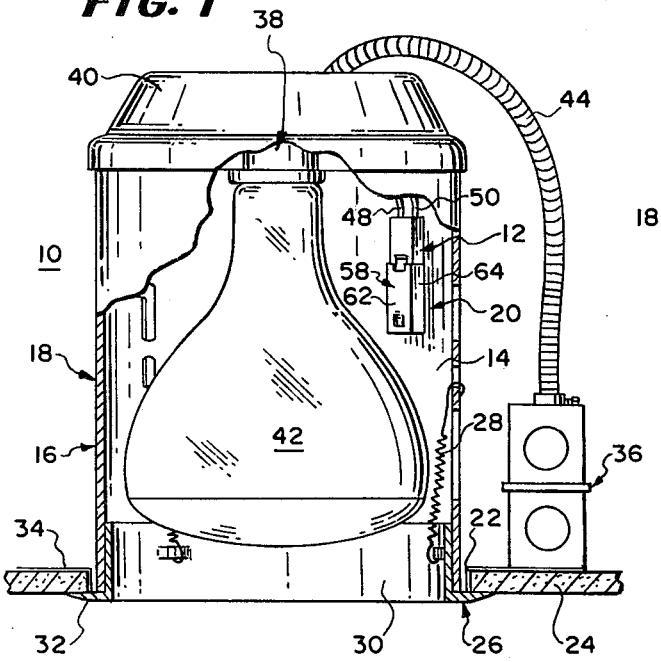
FIG. 1 is a side, partially sectioned view of a recess mounted lighting fixture including a thermal protective device mounted on the fixture housing at a predetermined location by means of a mounting arrangement according to the invention.
Figure 4:
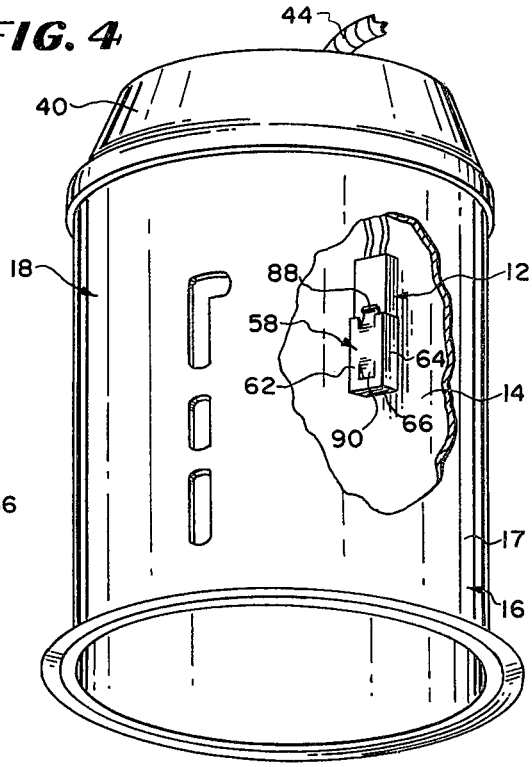
FIG. 4 is a partially sectioned, perspective view of the housing of the lighting fixture of FIG. 2 shown with the receptacle mounted on the inner surface of the side wall thereof and receiving a thermal protective device according to the invention.
Figure 2:
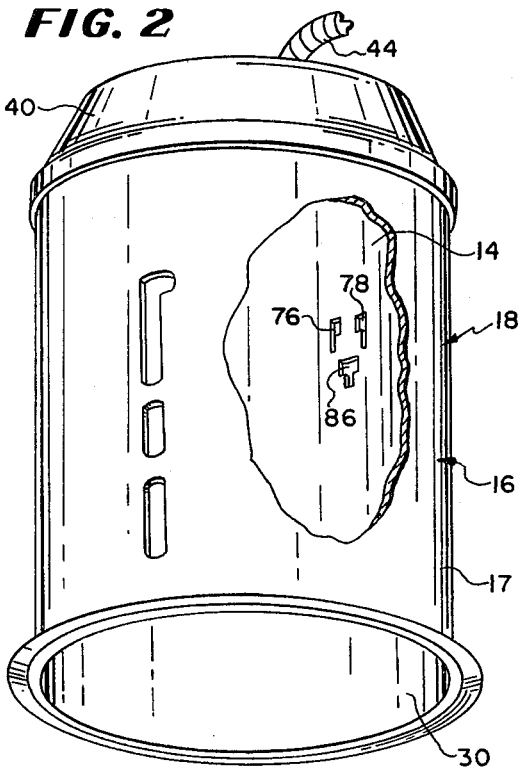
FIG. 2 is a partially sectioned, perspective view of the housing of the lighting fixture of FIG. 1 illustrating the inner surface of the side wall in which specially dimensioned apertures are defined for receiving a clip-on receptacle included as a part of the mounting arrangement according to the invention.
Figure 3:
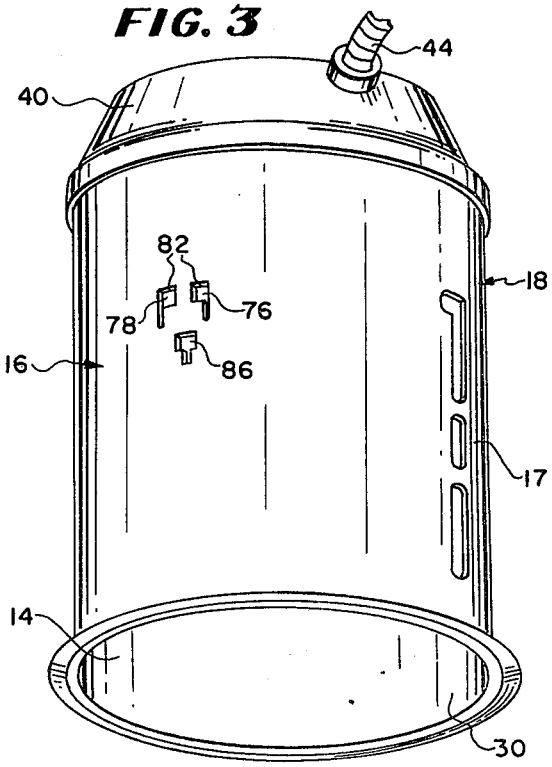
FIG. 3 is a perspective view of the housing of the lighting fixture of FIG. 1 illustrating the outer surface of the side wall in which the aforementioned apertures are defined for receiving a clip-on receptacle included as a part of the mounting arrangement according to the invention.

Referring now to the drawings in greater detail wherein like numerals have been employed throughout the various views to designate similar components, there is illustrated in FIG. 1 a recess mounted lighting fixture 10 including a thermal protective device 12 mounted on the inner surface 14 of side wall 16 of the lighting fixture housing or "can" 18 by means of a mounting arrangement designated 20, according to the invention.

The lighting fixture is of a conventional design including housing or "can" 18, herein shown as being cylindrical in shape, received in a circular aperture 22 defined in a ceiling support 24. A baffle or trim frame 26 is attached by coil springs 28 to housing 18 at the open end 30 of the housing. Frame 26 has an outer rim 32 which limits the insertion of the housing into ceiling support 24. A plaster frame 34 supports the housing and an electrical junction box 36 required to supply power to the fixture.

A socket assembly 38, shown only partially in FIG. 1, is mounted on the top wall of housing 18 for receiving a lamp 42 of the type shown. The socket assembly in the particular fixture shown is adjustable toward and away from open end 30 of the housing. Power from junction box 36 is provided to the socket assembly by means of a flexible armored cable 44 extending between the junction box and socket assembly.

Joined electrically in series between the incoming power leads and the socket assembly is thermal protective device 12. Device 12 includes a bimetallic or the like temperature sensitive switching mechanism 13 shown in dotted lines in FIG. 8, enclosed in an outer insulative plastic case 46. The switching mechanism is normally closed to permit current to pass from junction box 36 to the socket assembly for lighting lamp 42. Various types of thermal protective devices are available commercially. One variety of device conducts current directly through the bimetallic element thereof which becomes a part of the lamp circuit, while another variety of the device merely uses the bimetallic element to "make" and "break" the electrical lamp circuit, but is not actually a part thereof. Either type of thermal protective device is suitable for use in a recess mounted lighting fixture of the type described.

In the event the temperature immediately adjacent housing 18 rises sufficiently to open the bimetallic switching mechanism, current to the lamp is disconnected. When lamp 42 is not lighted, heat therefrom is no longer generated, resulting in a cooling of the housing 18 and the surrounding area. In turn, the switching mechanism cools and closes to reenergize lamp 42. Until the cause for overheating is removed, lamp 42 will continue to be cycled on and off as the excessive heat about housing 18 decreases and increases, respectively. The operation of the lamp to on and off conditions not only serves as a visual indication that a problem of overheating exists, but also prevents the excessive heat from increasing sufficiently to produce a fire.

The outer insulative case 46 of thermal protective device 12 shown in the drawings has an elongated shaped with rectangular walls joined together to form an enclosure for bimetallic switching device 13. A pair of leads 48, 50, enters on one end 52 of case 46 and a frame-shaped projection 54, herein shown as being square, extends from a side wall 56 of the case (see FIG. 7).

Figure 8:
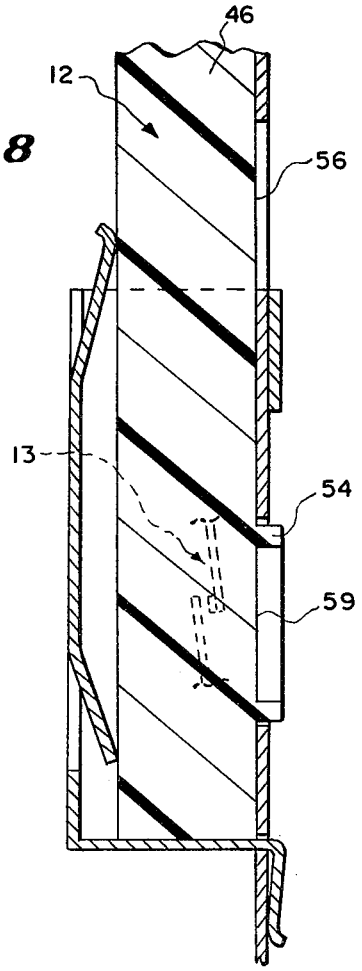
FIG. 8 is a sectional view of the mounting arrangement and thermal protective device of FIG. 6 taken along the line 8—8 thereof.

In the case of the thermal protective device shown, projection 54 defines an area or "window" 59 aligned with an area within case 46 whereat bimetallic switching element 13 is positioned (see FIG. 8). The insulative plastic material from which case 46 is fabricated is of a reduced thickness at "window" 59 to insure proper exposure of temperature sensitive mechanism 13 within case 46, to the area outside of housing 18. The plastic insulative material at "window" 59 is, however, of sufficient thickness to protect mechanism 13 from damage. Exposure of this "window" to the area surrounding the lighting fixture housing permits accurate sensing of the temperature along the outer wall surface of the lighting fixture housing. It has been discovered that the temperature at the outside of the lighting fixture housing is of greatest importance with respect to the occurrence of fires, etc., since it is the insulation and construction materials surrounding the lighting fixture housing which in most cases becomes overheated and ignites to produce a fire.

Other types of thermal protective devices not including a casing of the type shown in the drawings, may also be used. One commercially available thermal protective device includes a plastic tube or sleeve which is received over the bimetallic switching mechanism. Regardless of the type of thermal protective device used, it is important that the location of the bimetallic switching or temperature sensitive element included as a part of the thermal protective device, be aligned with predetermined opening 86 in the housing wall to insure accurate sensing of the temperature of the exterior area surrounding the lighting fixture housing.

Figure 7:
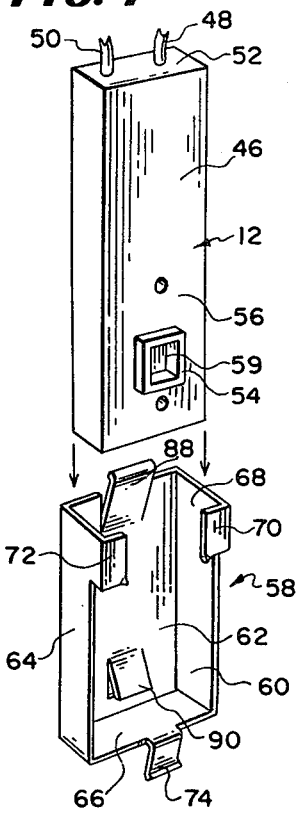

The preferred arrangement 20 for mounting thermal protective device 12 on the side wall of housing 18 includes a clip-on receptacle 58 shown best in FIG. 7. Receptacle 58 includes opposing side walls 60, 64, respectively, joined by a rear wall 62 and formed into a U-shape. The receptacle is closed off at one end by end wall 66. The opposite end 68 of receptacle 58 is open except for a spring tab 88 extending from wall 62 and overlying the open end. Open end 68 is provided, as will be described hereinafter, for receiving thermal protective device 12.

Figure 5:
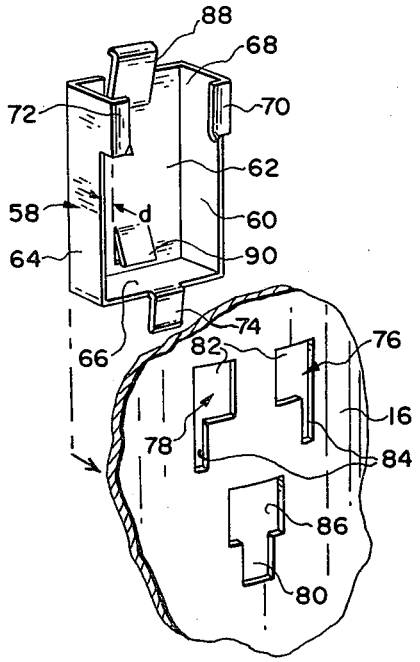
FIGS. 5–7 are enlarged, fragmentary perspective views of the side wall of the lighting fixture housing of FIGS. 1–4, illustrating the mounting of a thermal protective device on the inner surface thereof according to the invention.

Fingers 70, 72 extend outwardly a predetermined distance "d" (FIG. 5) from side walls 60, 64, respectively, and are thereafter bent in opposing relation to extend parallel to rear wall 62. Distance "d" is determined by the width of the side wall of housing 18 on which receptacle is to be mounted. A spring tab 74 extends outwardly from end wall 66. Fingers 70, 72 and tab 74 are positioned for receipt in specially shaped apertures 76, 78, 80, respectively, defined at predetermined locations in the side wall 16 of housing 18 (FIG. 5). Apertures 76, 78 have square, upper portions 82, integrally formed with lower, slotted portions 84, offset to one side of portions 82 and aperture 80 is generally "T" shaped with upper portion 86 of the T being shaped similarly to projection 54 defined on case 46 of thermal protective device 12 for receipt of the projection in aperture 86, as will be described.

Receptacle 58 is preferably fabricated of metal having a reflective surface. The reflective surface is provided to reflect light from lamp 42 of the lighting fixture away from the receptacle and in turn the thermal protective device 12 mounted therein. This is done to insure that the thermal protective device will sense primarily the temperature of the area surrounding the lighting fixture rather than the temperature within the confines of the fixture housing. In the event receptacle 58 is not constructed of reflective material, a reflective member may be located between the lamp and thermal protective device for the aforementioned purpose.

The location of aperture 86 is of importance for alignment of "window" 59 of the thermal protective device properly along wall 16 of the lighting fixture housing. It has been found that for most accurate temperature sensing, the bimetallic switching element 13 (FIG. 8) of the thermal protective device, be located on surface 14 of housing wall 16 a predetermined distance from the open, lower end 30 of the housing, along a line parallel to the longitudinal axis of the housing. The exact location along the housing side wall of any particular recess mounted lighting fixture may change in accordance with variations in the specifications of the fixture or its surroundings. Examples of the latter are: the dimension and shape of the fixture housing, the location of the socket plate within the housing; the type of insulation used to surround the lighting fixture housing; the wattage of the lamp employed in the lighting fixture; the type of lamp employed, i.e. a reflector type, an inside frosted type, etc.; the type of trim employed; i.e. open, closed, glass, reflective; the material of which the housing is constructed; i.e. steel, aluminum, etc.; and the ambient installation temperature of the environment in which the lighting fixture is employed.

When the aforementioned have been considered and a resulting location for the thermal protective device along the inside surface of the fixture housing wall has been determined, such locations will meet the standards set down by Underwriter's Laboratory referred to above. Accordingly, the lighting fixture will be properly protected to avoid fires caused by overheating in the vicinity of the fixture.

A typical lighting fixture housing of the type illustrated in the drawings is generally cylindrical having a diameter of about 5½–6½ inches and being about 7–7½ inches in height. The proper location of the bimetallic switching element of the thermal protective device in such housing has been determined to be approximately 3 to 3½ inches above the open end of the housing.

A pair of spring tabs 88, 90 defined on near wall 62 of the receptacle extend inwardly into the interior thereof. The purpose of spring tabs 88, 90 is to insure that the thermal protective device is urged into engagement with surface 14 of side wall 16 of the housing and to maintain "window" 59 of case 46 of the thermal protective device aligned with aperture 86 of the housing. The size of critically placed aperture 86 is of importance also. In the case wherein a thermal protective device of the type shown in the drawings is employed, aperture 86 is advantageously shaped complementarily to the frame-shaped projection 54. If a thermal protective device not having a projection such as 54, is employed, opening 86 need only be sufficiently large to permit the temperature sensing bimetallic element 13 to be exposed to the exterior of housing 18 therethrough. Too large an aperture will not enhance the operation of the thermal protective device and may be detrimental to such operation.

To mount receptacle 58 on the inner surface 14 of side wall 16 of housing 18, fingers 70, 72 and spring tab 74 are placed into apertures 76, 78 and 80, respectively, defined in the housing wall (see FIG. 5). The receptacle is then slid toward open end 30 of housing 18 until fingers 70, 72 and tab 74 engage outer surface 17 of side wall 16 of the housing, thereby securing the receptacle on side wall 16.

Figure 6:
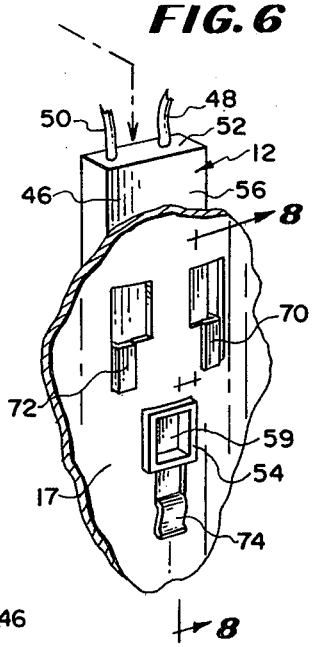

After receptacle 58 is in place on side wall 16, the thermal protective device is inserted into the receptacle with projection 54 surrounding "window" 59, facing side wall 16 of the housing (see FIG. 7). Case 46 of the thermal protective device is slid into the receptacle past spring tabs 88, 90 until the bottom wall of the case engages wall 66 of the receptacle. At this time, spring tabs 88, 90, urge side wall 56 of the thermal protective device into tight engagement with inner surface 14 of the side wall 16, causing projection 58 to pass through aperture 86, for aligning "window" 59 and bimetallic switch 13 within case 46 of the device, therewith (see FIG. 6).

Accordingly, the mounting arrangement of the present invention provides an efficient, yet inexpensive means for positioning a thermal protective device at a predetermined location on the side wall of a recess mounted housing of a lighting fixture. The mounting arrangement urges the thermal protective device into engagement with the side wall of the housing and at the same time positions the bimetallic temperature sensing switch of the thermal protective device properly for obtaining temperature readings of the critical area surrounding the lighting fixture housing.

While a preferred embodiment of the mounting arrangement for a thermal protective device has been shown and described herein, it should be understood that the invention is not limited thereto, since many modifications may be made. It is therefore contemplated to cover by the present application any and all such modifications as fall within the true spirit and scope of the appended claims.

I claim:

1. In a lighting fixture adapted for recessed mounting in a ceiling or the like support surface, said lighting fixture including an electrically operated lamp for illuminating an area adjacent said support surface and a thermal protective device connected electrically to said lamp for discontinuing the operation thereof in response to the temperature in an area adjacent the outside of said fixture reaching a predetermined temperature, said thermal protective device including temperature sensing means, a mounting arrangement for mounting said thermal protective device at a preselected location on said lighting fixture, said mounting arrangement including in combination:

a housing in which said electrically operated lamp is mounted, said housing including a side wall having interior and exterior surfaces, said housing being of a predetermined height and having an open end through which light from said lamp emanates, said side wall of said housing defining an aperture therein, said aperture being predeterminedly located along said side wall;

receptacle means for receiving said thermal protective device;

means for mounting said receptacle means on the interior surface of said side wall, said mounting means locating said thermal protective device with said temperature sensing means in alignment with said aperture defined in said side wall, whereby the temperature of the area adjacent said exterior surface of said housing side wall is sensed.

2. A mounting arrangement as claimed in claim 1 further including heat reflective means positioned in said housing between said thermal protective device and said lamp for reflecting heat emanating from said lamp away from said thermal protective device.

3. A mounting arrangement as claimed in claim 2 wherein said receptacle means includes a wall portion positioned between said thermal protective device and said lamp, said wall portion including reflective material for reflecting heat emanating from said lamp away from said thermal protective device.

4. A mounting arrangement as claimed in claim 3 wherein said receptacle means is U-shaped, with the open end of the U facing the inner surface of said side wall of said housing, and wherein said receptacle means is constructed of a heat reflective material.

5. A mounting arrangement as claimed in claim 1 wherein said housing defines a predetermined number of apertures in said side wall thereof, said apertures being predeterminedly located therein and wherein said means for mounting said receptacle means on said housing side wall includes finger means extending from said receptacle means and positioned for receipt in said apertures in said housing side wall, thereby said receptacle means is attachable to said side wall.

6. A mounting arrangement as claimed in claim 1 wherein said receptacle means includes means defined thereon, engagable with said thermal protective device for urging said device into contacting engagement with said interior surface of said housing side wall and for aligning said thermal protective device with said aperture in said side wall of said housing.

7. A mounting arrangement as claimed in claim 6 wherein said thermal protective device includes an outer case of insulative material in which said temperature sensing means is enclosed, said case being dimensioned for receipt in said receptacle means and wherein one wall of said case includes a frame-shaped projection defining an area aligned with said temperature sensing means within said case, said projection being dimensioned for receipt in said aperture in said side wall of said housing for aligning said temperature sensing means therewith and for securing said thermal protective device in said receptacle means.

8. A mounting arrangement as claimed in claim 7 wherein the insulative material forming said case in the area defined by said frame-shaped projection is of a reduced, predetermined thickness to permit thermal exposure of said temperature sensing means to the area surrounding said housing.

9. An arrangement for mounting a thermal protective device including a temperature sensing element, in a recess mounted lighting fixture, said fixture comprising a lamp connected to a source of electrical power through said thermal protective device said thermal protective device acting to discontinue the operation of said lamp in response to the temperature in an area surrounding the outside of said lighting fixture reaching a predetermined temperature and a housing in which said lamp is mounted, said housing being of a predetermined shape and having an open end through which light from said lamp emanates for illuminating an area adjacent said housing, said mounting arrangement including in combination;

a side wall of said housing having interior and exterior surfaces, said housing side wall defining a predeterminedly located and predeterminedly dimensioned aperture therethrough;

a receptacle dimensioned for receiving said thermal protective device; and means for attaching said receptacle on the interior surface of said side wall of said housing so that said temperature sensing element of said thermal protective device is positioned generally in alignment with said aperture in said housing side wall, said receptacle including means for urging said thermal protective device into contacting engagement with said interior surface of said side wall of said housing.

10. A mounting arrangement as claimed in claim 9 wherein said fixture housing is cylindrical in shape having a circular cross-section, wherein the diameter of the open end of said housing is generally about 5½–6½ inches, wherein the height of said housing is generally about 7–7½ inches and wherein said location of said aperture in said housing side wall is approximately 3–3½ inches from the open end of said housing along a line parallel to the longitudinal axis of said housing.

11. A mounting arrangement as claimed in claim 9 further including light reflective means positioned in said fixture housing between said thermal protective device and said lamp for reflecting heat emanating from said lamp away from said thermal protective device.

12. A mounting arrangement as claimed in claim 11 wherein said receptacle is U-shaped, having joined rear and side walls, said side walls being attachable to said side wall of said housing perpendicularly thereto to provide an enclosure for said thermal protective device, at least said rear wall of said receptacle including a reflective surface for reflecting heat from said lamp away from said thermal protective device.

13. A mounting arrangement as claimed in claim 12 wherein said receptacle further includes resilient finger means engageable with said thermal protective device for urging said thermal protective device into contacting engagement with the interior surface of said housing side wall.

14. A mounting arrangement as claimed in claim 13 wherein said thermal protective device includes an outer case of insulative material enclosing said temperature sensitive element, said case being dimensioned for receipt in said receptacle, one wall of said case including an area of reduced wall thickness, said area being aligned with said temperature sensing element, said thermal protective device being positionable in said receptacle with said area of said case being in alignment with said aperture in said housing side wall, thereby to thermally expose said temperature sensing element to the area surrounding said housing.

15. A mounting arrangement as claimed in claim 14 wherein said case of said thermal protective device further includes a frame-shaped projection surrounding said area of reduced wall thickness, said frame-shaped projection being dimensioned for receipt in said aperture defined in said housing side wall for securing said thermal protective device in place thereon and for aligning said temperature sensitive element with said aperture.

* * * * *